United States Patent [19]

Johnson et al.

[11] Patent Number: 5,062,337

[45] Date of Patent: Nov. 5, 1991

[54] INDEXABLE MULTI-TOOL FOR PUNCH PRESS

[75] Inventors: Gary E. Johnson, Ramsey, Minn.; Richard M. Eckert, Eggertsville, N.Y.

[73] Assignee: Strippit, Inc., Akron, Ohio

[21] Appl. No.: 351,413

[22] Filed: May 12, 1989

[51] Int. Cl.[5] ..... B26D 5/02

[52] U.S. Cl. ..... 83/552; 83/640; 83/454

[58] Field of Search ..... 83/140, 382, 451, 453, 83/454, 456, 549, 552, 550, 559, 588, 551, 405

[56] References Cited

U.S. PATENT DOCUMENTS 1,940,883 12/1933 Rollings .
3,527,130 9/1970 Knehroms ..... 83/454
4,220,062 9/1980 Blanz .
4,532,845 8/1985 Jinnouchi .
4,555,966 12/1985 Klingel .

FOREIGN PATENT DOCUMENTS 2267170 11/1975 France .
WO88/09232 12/1988 PCT Int'l Appl. .
657567 9/1986 Switzerland .
2071554 9/1981 United Kingdom .
2169233 10/1985 United Kingdom .

OTHER PUBLICATIONS

Brochure entitled: Finn-Power Turret Punch Presses for the 21st Century, Copyright 1988, pp. 1-12.
Manual for Mate Finn-Power Multi-Tool, Copyright 1988 pp. 1-8.

*Primary Examiner*—W. Donald Bray
*Attorney, Agent, or Firm*—Hill, Van Santen, Steadman & Simpson

[57] ABSTRACT

An indexable multi-tool for punch presses wherein a plurality of individual punches are held at a singly punching station in a turret-type punch press such that any one of the plurality of punches can be selected upon a rotation of a punch carrier relative to the turret. A striker is carried in the indexable station which does not rotate relative to the turret and which contains an axially extending portion under which the selected punch is positioned in order to be used for punching. Stripper buttons are held on the indexable station by a rotating ring for easy removal and die buttons are held in a die carrier to rotate synchronously with the indexable station.

24 Claims, 5 Drawing Sheets

INDEXABLE MULTI-TOOL FOR PUNCH PRESS

BACKGROUND OF THE INVENTION

The present invention relates generally to a turret punch press having a pair of upper and lower turrets rotatably mounted to automatically bring respective punches and dies into alignment for punching a variety of holes in sheet materials and, more particularly, to an apparatus for rotating a set of punches and dies at a single punching station in the upper and lower turrets for punching a wider variety of holes with the same turret.

U.S. Pat. No. 4,658,688, assigned to the assignee of the present application, discloses a punch press having multiple punch tool rotatable turrets wherein at least one of the punch tools on each of upper and lower turrets is indexable to different angular orientations. Rotation of the indexable punch tools is accomplished by a slidably mounted motor for engagement with a timing pulley, which through a timing belt and harmonic gear drive, acts to rotate the punch tools. A break and position sensors are also provided. Synchronization of punch and die orientation is achieved through servos and control.

U.S. Pat. No. 4,569,267 discloses a punch press which uses a punch tool assembly which contains at least two punch pins of different diameters or cross-sections which are interchangeable in the working position by a control element which is slidable about the pin support member, and actuating means. When the punch tool assembly is rotatable about the ram to effect the movement of the punch pins from operative to inoperative positions, then a cooperating movable die is provided in order to ensure that the aligned die bores are cooperatively dimensioned and configured with respect to the punch pins. The punch tool assembly is held on the ram and moves with the ram and the pins, when not being used, are held in an elevated position while the operative pin is rigidly locked into a protruding position.

SUMMARY OF THE INVENTION

It is an object of the present invention to provide a highly accurate and reliable indexable punch and die on a rotatable turret punch press.

This and other objects of the present invention are embodied in an indexable punch press of the type disclosed in U.S. Pat. No. 4,658,688 noted above, in which there is a further indexing available at at least one work station in the turret. An improved die holder is also provided.

A punch assembly is provided at a punching station in the turret, which punch assembly carries a plurality of individual punches. The punch assembly may be rotated so that a selected one of the plurality of punches will underlie a portion of the striker body acted upon by the ram which causes the selected punch to extend downwardly below the punch assembly so as to pierce the sheet material being acted upon.

Stripper buttons are held at a bottom portion of the punch assembly by undercut grooves which capture flanges on the buttons and by a rotatable circumferential ring extending around the entire periphery of the punch assembly which have spaced flanges to selectively overlie and capture the buttons. Thus, the buttons may be easily and quickly removed and replaced either when damaged, or when the punches are being changed.

The die holder receives a plurality of corresponding die buttons having openings therein corresponding to the punches. The buttons are also easily removable and replaceable and are held in specific orientations, as required, by keys which may be reversed in orientation. Set screws are used to hold the die buttons in place.

DESCRIPTION OF THE PREFERRED EMBODIMENTS

Figure 1:
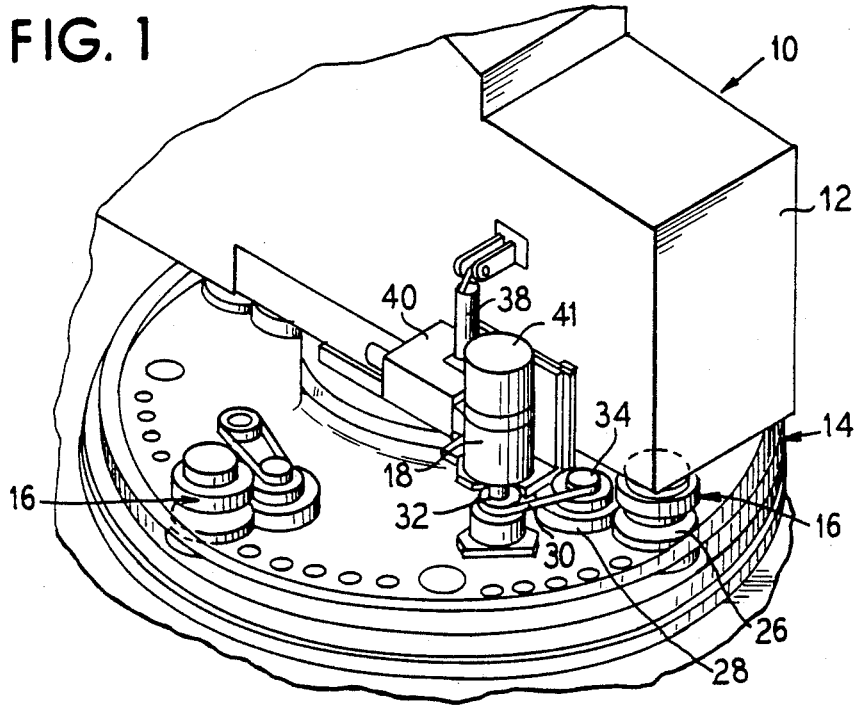
FIG. 1 is a perspective view of an upper turret portion of a device according to the principles of the present invention.

Referring to FIG. 1, the device of the present invention is shown generally at 10 and includes a punch press housing 12, a rotatable turret 14, at least one indexable punching tool 16, and a punching tool drive motor 18. More specifically, a ram 20 (FIGS. 2 and 4) is disposed in the punch press housing 12 for driving a punch P through a piece of sheet material M and into a die D. A plurality of punches P and dies D are mounted adjacent the perimeter of respective upper and lower turrets 14 and 24 which are rotatable to bring corresponding punches P and dies D under the ram 20. At least one indexable punch tool 16 is mounted within the rotatable upper turret 14 and a corresponding indexable die 22 is mounted in the lower turret 24 so that the indexable punch 16 and die 22 may be brought into registration under the ram 20.

The indexable punch 16 is provided with a geared bushing 26 that is rotatably driven by a harmonic drive gear box 28 which in turn is driven by timing belt 30 connecting a pair of pulleys 32 and 34. The servo motor 18 is mounted on the punch press housing 12 by a vertical slide 36 and is selectively engageable to the drive pulley 32. Vertical movement of the servo motor 18 in the slide 36 is provided by an actuator 38 such as a pneumatic actuator, connected between the motor slide 36 and the punch press housing 12. The servo motor 18 may be locked into its respective upper and lower positions by a slide lock mechanism 40. A resolver 41 provides feedback from the motor 18 to a programmed controller (not shown) to monitor the angular rotation of the motor 18.

Figure 2:
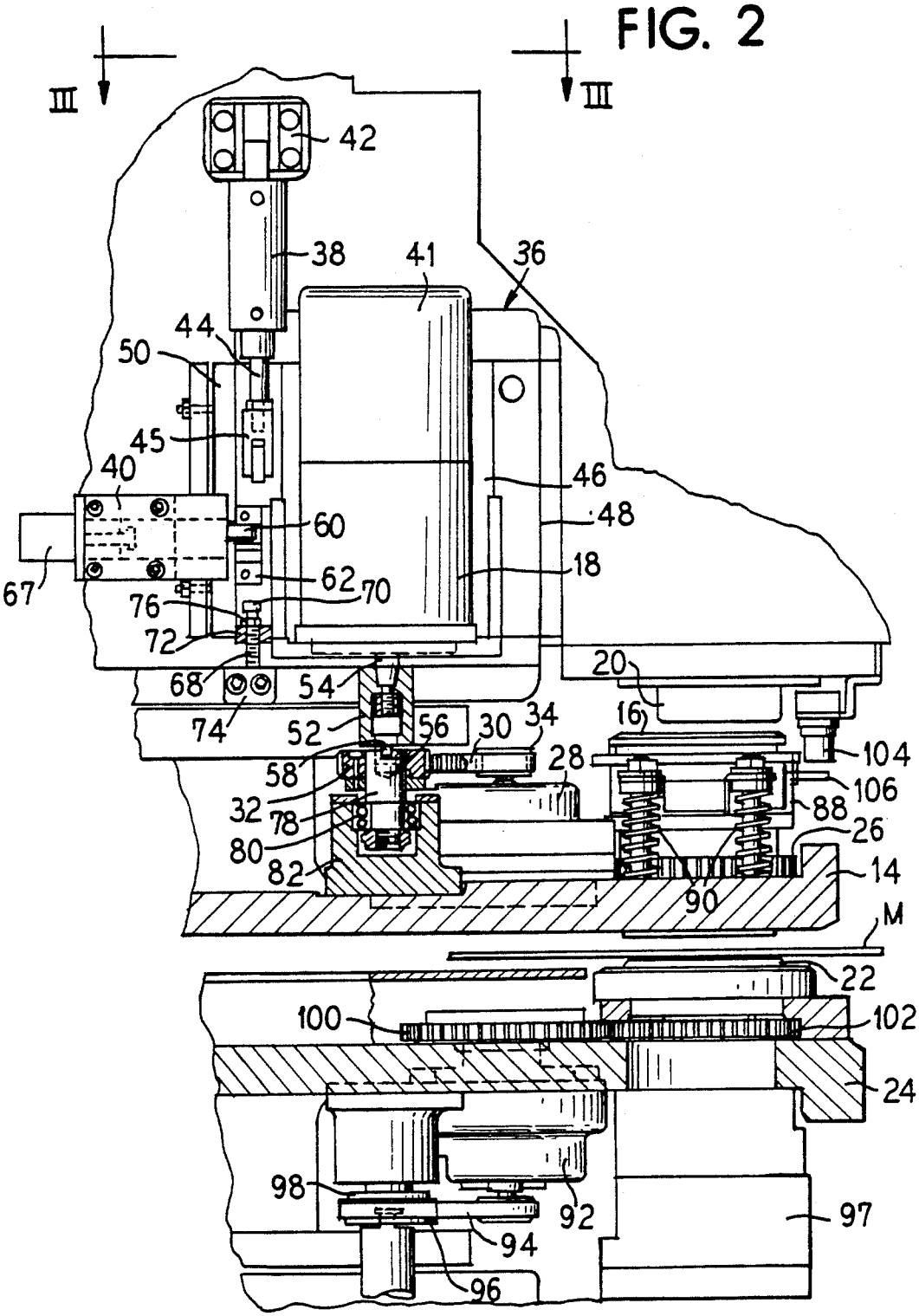
FIG. 2 is an enlarged side elevational view of the device of the present invention shown partially cut away.

FIG. 2 shows the motor 18 slidably mounted on the housing 12. The pneumatic actuator 38 is connected at an upper end thereof to the punch press housing 12 by a bracket 42. An extendable arm 44 of the actuator 38 is connected by a clevis 45 to a slide plate 46 on which the motor 18 is mounted. The slide plate 46 slides vertically within slide rails 48 and 50 so that the motor 18 may be selectively engaged with the driver pulley 32.

Coupling between the motor 18 and the driver pulley 32 is accomplished by a coupling 52, such as a helical single flex coupling. The helical coupling is connected at one end thereof to a shaft 54 of the motor 18 and at the other end thereof to a shaft and tang arrangement 56 which engages a shaped opening 58 in the drive shaft 78. The helical coupling 52, such as coupling made by Helical Company, includes a helical spring (not shown) that provides relatively rigid torsional connection between the shaft 54 and the tang and shaft assembly 56, yet which gives relatively easily in a vertical direction so that misalignment of the motor 18 with the drive pulley 32 is accommodated while still transmitting the torque of the motor 18.

The slide plate 46, and the motor 18 mounted thereto, may be locked in either the coupled and uncoupled positions by a motor slide lock 40 mounted on the punch press housing 12. The motor slide lock 40 includes a shot pin 60 which is selectively insertable into a bracket 62 mounted on the slide plate 46. The bracket 62 includes first and second openings 64 and 66 through which the shot pin 60 is inserted to lock the slide plate 46 and motor 18 into the respective coupled and uncoupled positions. Movement of the shot pin 60 is controlled by an actuator 67, such as a pneumatic actuator.

An adjustable mechanical stop 68 is provided on the slide 36 in the form of a vertically disposed bolt 70 extending through an arm 72 on the slide plate 46. The bolt 70 abuts a flange 74 extending from the punch press housing 12 when the motor 18 and slide plate 46 are in the engaged position. A lock nut 76 is provided on the bolt 70 to lock the bolt 70 into position. The stop 68 prevents excessive vertical loading on the coupling 52.

When the motor 18 is in the coupled position, the helical coupling 52 provides torsional coupling between the motor shaft 54 and the drive pulley 32. The drive pulley 32 is fixed to the pulley shaft 78 which is mounted for rotation about a vertical axis by bearings 80 within a bearing housing 82. The bearing housing 82 is fastened to the turret 14.

The toothed timing belt 30 extends between the drive pulley 32 and the second pulley 34. Each of the pulleys 32 and 34 are toothed, corresponding to the teeth on the inner surface of the timing belt 30, thereby providing positive rotational drive between the pulleys 32 and 34. The second pulley 34 drives the harmonic gear drive 28. The harmonic gear drive 28 drives the geared bushing 26 on the indexable punch 16 to provide rotation thereof.

The indexable punch 16 is provided with an annular lifter ring 88 extending therearound which is connected to lifter springs 90 extending from the turret 14 to the lifter ring 88. The ram 20 is shown above the punch 16 and during operation will drive the punch 16 through a piece of sheet material M and into the die 22. The lifter ring 88, in conjunction with the springs 90, then returns the punch 16 to its original position, lifting it from the sheet material M.

A portion of the lower turret 24 is also shown in FIG. 2. It includes the indexable die 22 which is rotated by a harmonic gear drive 92 which in turn is driven by a timing belt 94 that is driven by a vertically slidable motor (not shown) slidably mounted on the punch press housing 12 below the lower turret 24. The motor is coupled to a drive pulley 96 by a helical coupling 98. The harmonic drive 92 extends into the lower turret 24 and includes an output gear 100 engaging a geared bushing 102 encircling the die 22. An anvil portion 97 of the punch press 10 can be seen supporting the lower portion of the turret 24 to resist the downward force of the ram 20 as it pushes the punch P through the sheet material M and into the die 22.

A proximity switch 104 is mounted to the housing 12 and senses a target 106 on the lifter 88 to indicate that an indexable station has retracted from the material M and is safe to move the material M. Once the turret is positioned under the ram 20, a home position of the indexable punch 16 is established by a second proximity switch (not shown) mounted on the housing 12. A vane (not shown) extends from the punch bushing 26 to activate the proximity switch when the bushing 26 and the punch 16 are rotated to home position. There are other sensors (not shown) to indicate that an indexable station is positioned below the ram 20. These sensors are of proximity type and mounted on the frame 12. A target on the bushing of the die 22 is selectively sensed by a frame mounted switch (not shown). To prevent damage to the frame mounted switch it is preferably mounted on a pneumatic cylinder so that it may be moved toward the die 22 to sense the target and then move away before operation of the ram 20 or rotation of the turret 24.

Figure 3:
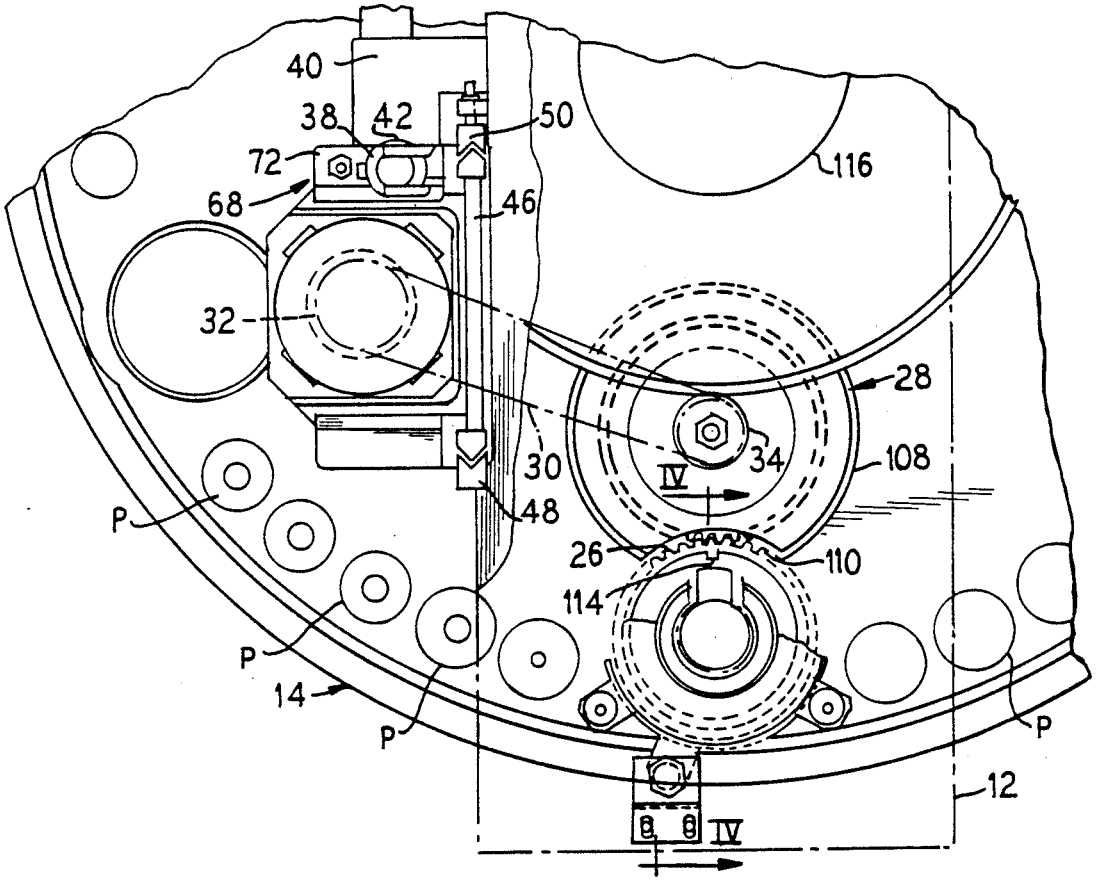
FIG. 3 is a plan view of the device shown in FIG. 2 generally at lines III—III.

FIG. 3 shows the upper turret 14 from above including a plurality of punches P. The slide plate 46 is mounted between the V-shaped slide rails 48 and 50. The pneumatic actuator 38 is seen suspended from the bracket 42 and the slide lock 40 and the arm 72 of the mechanical stop 68 can be seen more clearly. The timing belt 30 extends from the drive pulley 32 to the second pulley 34 under the housing 12. The harmonic gear drive 28 is enclosed by a housing 108 having a shaped opening 110 through which extends the geared bushing 26 of the indexable punch 16. The indexable punch 16 is keyed to the geared bushing 26 by a key 114. The turret 14 is rotatable about a turret axis 116 to bring other punch tools P under the ram 20.

Figure 4:
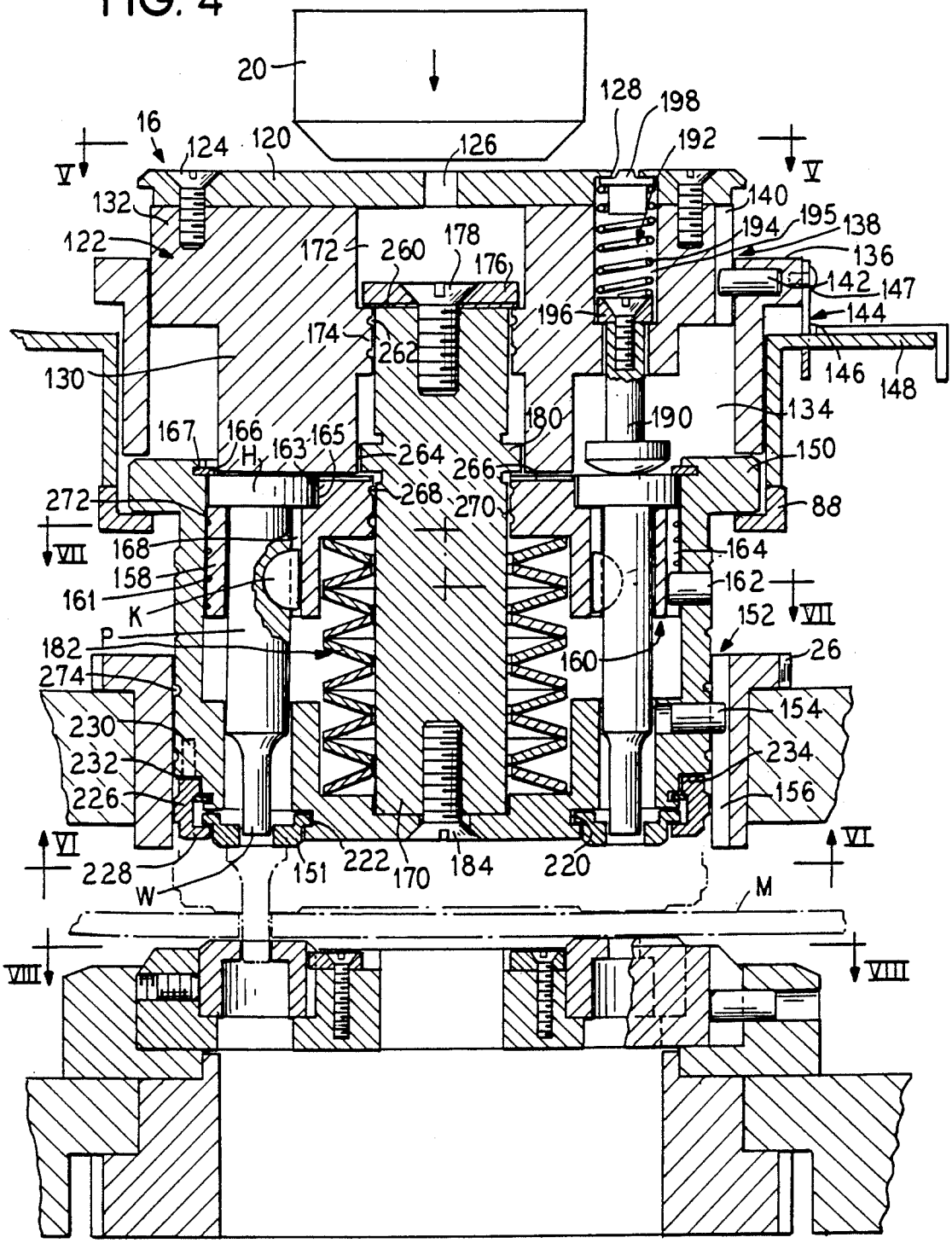
FIG. 4 is a cross-sectional view of the punching tool taken generally along the lines IV—IV of FIG. 3.
Figure 7:
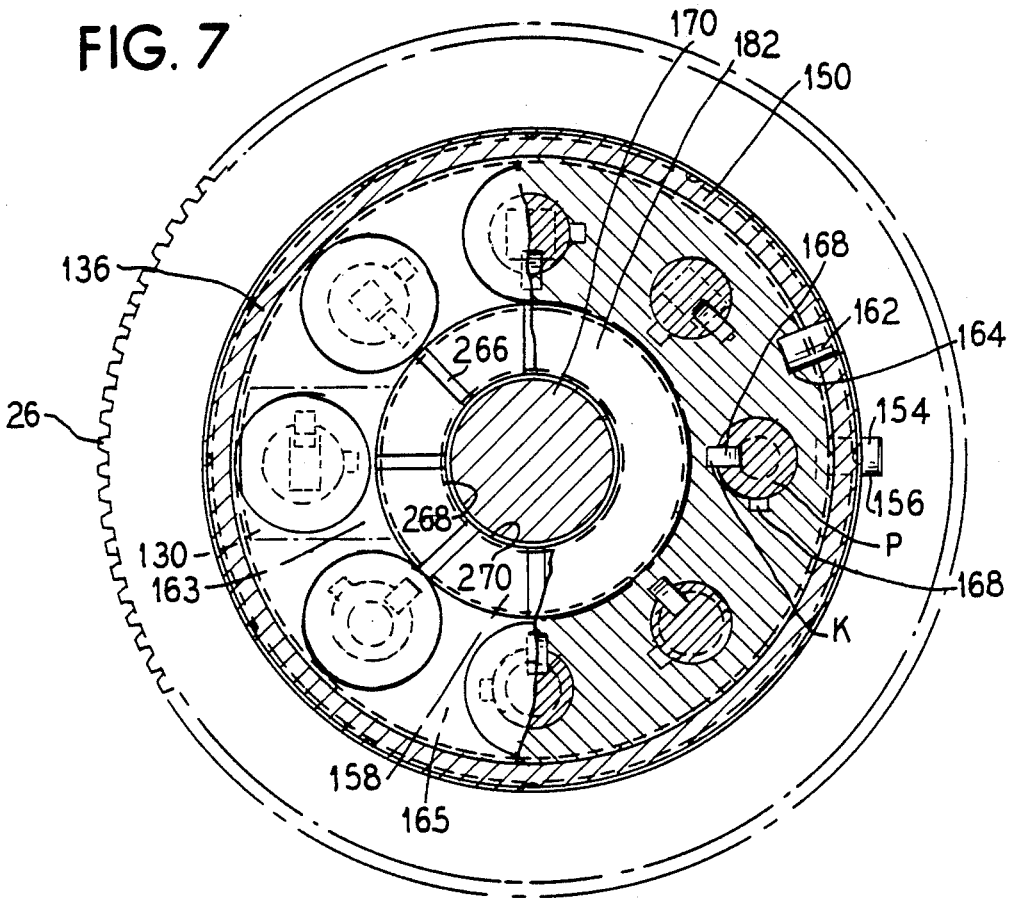
FIG. 7 is a cross-sectional view of the device shown in FIG. 4 along lines VII—VII.

FIG. 4 shows the punching tool 16 in greater detail as it is positioned below the ram 20 in a ready to work position. The punching tool 16 comprises a top striker cap 120 which is engaged by the ram 20 during a punching operation. The cap is secured to a striker body 122 by appropriate fastening means 124 such as threaded fasteners (see also FIG. 5). The striker cap 120 has a plurality of apertures 126,128 therethrough to permit the introduction of lubricating oils into the interior of the punching tool 16. The striker body 122 is generally annular in shape and as seen in phantom in FIGS. 5 and 7, includes a radial arm 130 which overlies a selected one of the punches P carried in the punching tool 16. The radial arm 130 extends axially downwardly from a main upper annular portion 132 of the striker body, thus leaving a relieved area 134 in the remaining circumferential area below the main upper body portion. The striker body 122 is vertically reciprocably carried in a lift sleeve member 136 and is prevented from rotating relative to the lift sleeve member by appropriate guide means 138 such as a vertical groove 140 formed in the striker body 122 and a guide pin 142 carried by the lift sleeve member 136. Thus, the striker body 122 will be free to move vertically relative to the lifter sleeve, however, will be prevented from rotating relative thereto.

Figure 5:
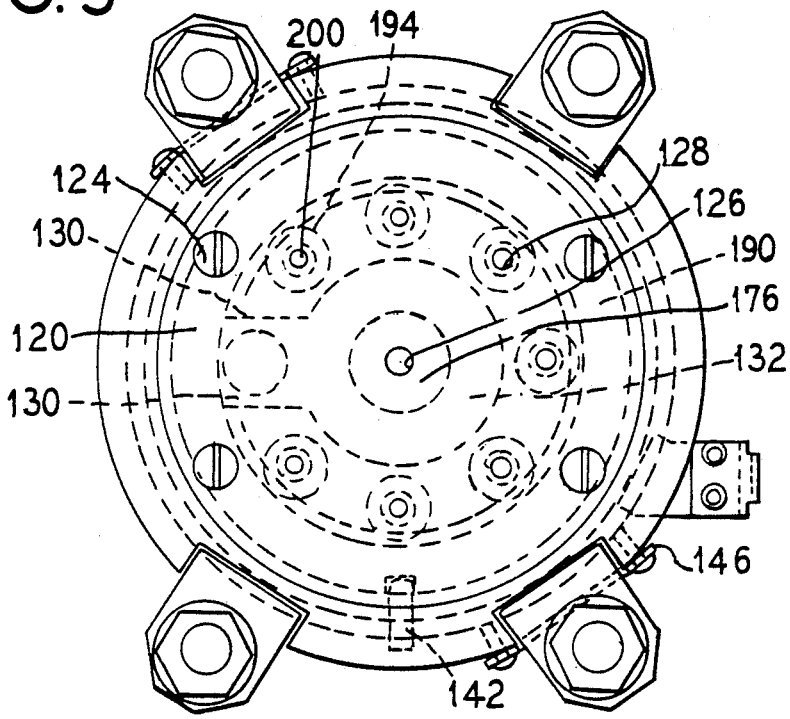
FIG. 5 is an elevational view of the device shown in FIG. 4 along lines V—V.

The lifter sleeve member 136 is in turn held against rotation relative to the lifter ring 88 by appropriate guide means 144 such as a retainer clip 146 mounted on the lifter sleeve member 136 by appropriate fastening means 147 such as threaded fasteners. The retainer clip straddles a bracket 148 on the lifter ring 88 (FIG. 5). Thus, the lifter sleeve member 136 will be free to move vertically relative to the lifter ring 88, however, will be prevented from rotating relative thereto.

The lifter sleeve member 136 is normally supported on a stripper guide 150. The stripper guide 150 forms a lower outer portion of the indexable punch 16 and includes vertical passages 149 for receiving a lower portion of the punches P. The stripper guide also removably receives stripper buttons 151 as described in greater detail below. The stripper guide 150 is vertically reciprocally positioned within the geared bushing 26 and is keyed to that bushing by appropriate guide means 152 such as a radially projecting pin 154 carried by the stripper guide 150 which is received in a vertical slot 156 in the bushing 26. Thus the stripper guide 150 will be free to move vertically relative to the bushing 26, however, will be prevented from rotating relative thereto.

The stripper guide 150 surrounds a punch carrier 158 and is keyed thereto by appropriate guide means 160 such as a radially inwardly projecting guide pin 162 which is received in a vertical slot 164 formed in the punch carrier 158. Thus, the punch carrier 158 will be free to move vertically relative to the stripper guide 150, however, will be prevented from rotating relative thereto.

The punch carrier 158 has a plurality of vertically oriented passages 161 in which are received upper portions of the punches P. The punches P each have an enlarged head H which is received in an annular recessed area 163 formed at the top end of the punch carrier 158. A shoulder 165 is thus formed at the surface formed by the recessed area which supports the head H of the punch P. The stripper guide 150 extends to an elevation above the head H of the punches and a retaining ring 166 is snapped into a groove 167 in the stripper guide to closely overlie the heads H of the punches.

Each of the punches P normally has a key K which is received in a vertical slot 168 in the punch carrier 158 to keep the punch angularly oriented within the punch carrier 158. This is particularly required when the punch P does not have a circular working end W. If the punch P has a working end that could be oriented to give different shapes upon a 90° rotation, two vertical slots 168 might be provided (See FIG. 7).

A center post 170 is used to hold the punch carrier 158 against the striker body 132. The center post 170 is positioned within a central vertical passage 172 in the striker body 132. The central vertical passage 172 includes an annular shoulder 174 which projects into the passage 172 and the post includes a post cap 176 which is removably secured to the post 170 by appropriate fastening means 178, such as a threaded fastener, such that the post will be prevented from moving downwardly relative to the striker body 132 once the cap 176 engages the shoulder 174.

The post 170 also has an annular shoulder 180 formed thereon which is positioned below the striker body shoulder 174 and which overlies the punch carrier 158. The punch carrier 158 is pressed against the post shoulder 180 by means of appropriate biasing means 182 which may be in the form of a conical spring or Belleville washer. A bottom end of the post is secured to the stripper guide 150 by appropriate fastening means 184, such as a threaded fastener. In this manner, the entire punch tool assembly is held together.

In operation, as the ram 20 descends, it strikes the striker plate 120 and causes the entire punch 16 to move downwardly, including the lifter ring 88, which moves downwardly against the bias of the lifter springs 90. When the entire punch assembly has moved downwardly enough to cause the stripper buttons 151 to engage the sheet material M, as shown in phantom in FIG. 4, compression of the biasing means 182 occurs, causing the punch carrier 158 to move downwardly relative to the stripper guide 150. As this occurs, the striker body 122, through the projection 130, continues to press against one of the punches P, resulting in that punch being extended beyond a bottom of the stripper button 151. The remaining punches are not engaged by the extension 130, but rather by skid posts 190 which are carried on the striker body 132 in the recessed area 134. The skid posts 190 are normally biased downwardly by biasing means 192 which may be in the form of a coil spring 194. The coil spring is captured in a vertical passage 195 between an enlarged end 196 of the skid posts 190 and a plug or cap 198 normally sealing the opening 128 to the passage 195. The cap 198 can be pressed downwardly to provide access to the passage 195 to introduce lubricants thereinto, and, upon release of the cap 198, it will return upwardly to a sealing position to prevent entry of contaminants into the passage 195. The springs 192 are weaker than biasing means 182 and therefore, once the other punches engage the sheet material M, those other punches will stop their downward movement relative to the material M. Only the ram 20, striker plate 120, striker body 132, stripper guide 150 and the individual punch under the extension 130 will continue the downward movement to pierce through the material M.

When the ram 20 has terminated its downward stroke and begins to move upward, first the extended punch will move upwardly by action of the biasing means 182 and then the entire punch assembly 16 will move upwardly by action of the lifter springs 90.

Figure 6:
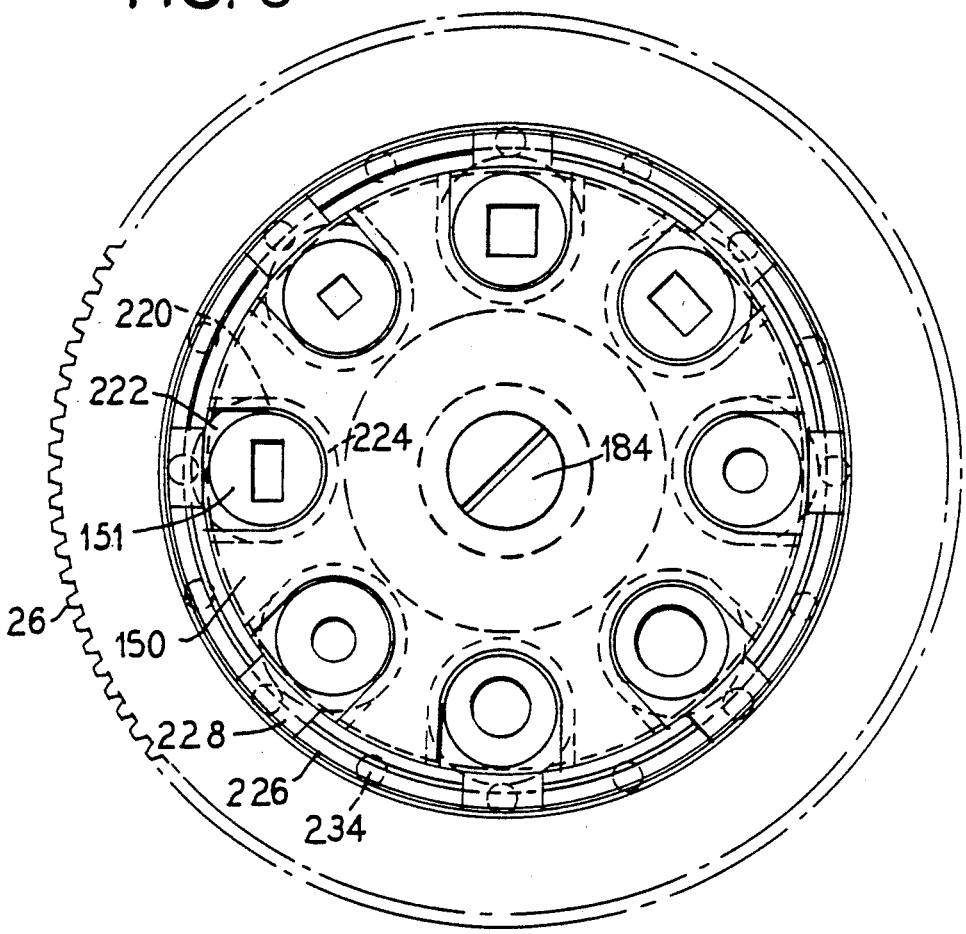
FIG. 6 is a cross-sectional view of the device shown in FIG. 4 along lines VI—VI.

As best seen in FIGS. 4 and 6, the stripper buttons 151 are held in place on the lower end of the stripper guide 150 by means of undercut slots 220 which receive a flange 222 of the buttons 151 around one half of their circumference. An open side of the slot, opposite a bight 224 thereof, is selectively closed by a rotatable ring 226 having spaced inturned flange sections 228 which will overlie the button flanges 22 when the ring is properly rotated. A detent member 230 is carried by the punch carrier 150 and has a projection 232 projecting downwardly into one of a plurality of spaced recesses 234 formed in the ring to selectively hold the ring in a desired orientation. Thus, the ring can be moved from a locking position where the ring flanges 228 overlie the button flanges 222, or to a position where the ring flanges 228 are spaced between the slots 220 such that the buttons 151 will be free to be removed from the punch carrier 150.

Figure 8:
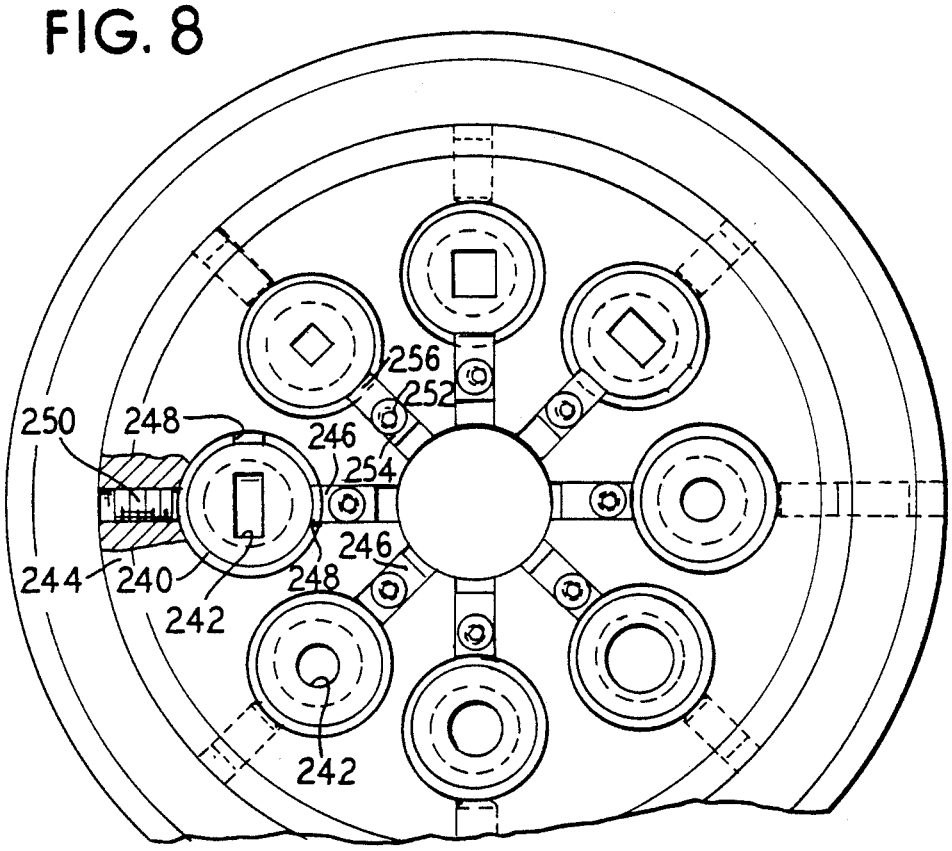
FIG. 8 is an elevational view of the device shown in FIG. 4 along lines VIII—VIII.

FIGS. 2 and 8 illustrate the dies D which are positioned below the punches P. The dies include removable and replaceable die buttons 240 having openings 242 which correspond to the overlying punches. The die buttons 240 are held in a die carrier 244 and are keyed to specific angular orientations (when the die opening is not circular) by reversible keys 246 which engage into a selected slot or recess 248 in the particular die button 240. Die buttons which have openings 242 that may be oriented differently (rectangular as opposed to square) have more than one slot 248 to correspond to the different possible orientations. Set screws 250 are provided to lock the buttons 240 in place and to prevent them from lifting out of the die carrier 244 when the punch is retracted from the die D. The keys 246 have a rectangular shape and are secured by means of a threaded fastener 252 extending through said key at a location spaced from a center of the key, such that, as measured from said fastening location, said keys have a long end 254 and a short end 256. Since the keys 246 are reversible, when a button 240 is used which has a circular opening 242, the orientation of the key 246 is reversed presenting the short end 254 toward the button 240 which terminates short of the button 240. Otherwise, the long end 256 of the key is oriented toward the button 240 so that it will extend into the slot 248.

The apertures 126 and 128 were identified above as providing inlets for lubricating oils. From aperture 126, which communicates with the passage 172 formed in the center of the striker body 122, oil is permitted to flow between the push cap 176 and the striker body shoulder 174 in a small passage 260 which communicates with a spiral oil groove 262. The oil that is permitted to flow down between shoulder 180 on the post and the striker body 122 through a small passage 264 onto a top of the punch carrier 158. A plurality of radial grooves 266 are provided on the top surface of the punch carrier 158 (see FIG. 7) to permit passage of the oil radially along the top of the punch carrier. A spiral oil groove 268 is also provided in a central passage 270 of the punch carrier 158 to permit oil to flow down through the area of the biasing means 182.

Oil flowing radially through the passage 266 on the top of the punch carrier 158 is permitted to continue a downward flow through a spiral groove 272 formed on an outer circumference of the punch carrier 158 which normally abuts against the stripper guide 150. This oil then flows down around the working end W of the punch as does the oil flowing through the area of the biasing means 182. An additional spiral oil groove 274 is provided on the outer circumference of the stripper guide 150 to permit lubrication between the stripper guide and the geared bushing 26. Thus, lubricating oil is provided between all of the sliding surfaces to reduce friction and heat build up within the punch assembly.

Rotation of the geared bushing 26 by the punch press control means causes rotation of the portion of the punch assembly 16 below the striker body 122 which thus moves a selected punch P into a working position below the striker extension 132 while disposing the other punches carried in the stripper guide 150 in an inactive position under the recess 134. The movable skid posts 190 and retainer ring 166 prevent the inactive punches from bouncing upwardly in the punch carrier in response to vibrations of the punch. In this manner, only one punch is moved to a working position while all of the other punches are held in an inactive position.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

We claim as our invention:

1. In a punch press for punching a sheet material, the combination comprising:

a housing;

a ram reciprocably mounted in said housing;

a punch assembly removably supported below said ram and including a striker means, a punch carrier means and a stripper guide means underlying said ram, at least two punches supported by said punch carrier means and movable relative to said stripper guide, said punches each having a working end adapted to strike the associated sheet material and an opposite end being selectively engageable, when in a working position, by said striker means acted upon by said ram, to move said punch along an axis parallel to the axis of reciprocation of said ram, and control means for moving a selected one of said punches to said working position and concurrently operable to dispose the at least one other punch in an inactive position so that only the selected one of said punches is in said working position;

wherein said striker means includes a radially and axially projecting portion which overlies said punch carrier means, and said punch carrier means is rotatable below said striker means to present a selected one of said punches below said projecting portion.

2. A punch press according to claim 1, wherein said striker means includes a radially and axially projecting portion which overlies said punch carrier means and said working position is located below said projecting portion.

3. A punch press according to claim 1, further comprising means for biasing said punch carrier means away from said stripper guide means.

4. A punch press according to claim 1, further comprising means for biasing said punches continuously downwardly into said stripper guide means.

5. A punch press according to claim 1, including a die carrier means mounted to rotate synchronously with said punch carrier means to locate cooperating die bores thereof in alignment with cooperating punches.

6. A punch assembly for a punch press comprising:

a striker;

a punch carrier underlying said striker and being rotatable relative to said striker;

said punch carrier being adapted to carry a plurality of separate punches;

a stripper guide underlying said punch carrier and being vertically movable relative to said punch carrier;

coupling means for coupling said punch carrier to move vertically with said striker and to rotate about a vertical axis with said stripper guide.

7. A punch assembly according to claim 6, wherein said striker includes a radially and axially projecting portion which overlies said punch carrier, and said punch carrier is rotatable below said striker to present a selected one of said punches below said projecting portion.

8. A punch assembly according to claim 6, further comprising means for biasing said punch carrier away from said stripper guide.

9. A punch assembly according to claim 6, further comprising means for biasing said punches continuously downwardly into said stripper guide.

10. A punch assembly according to claim 6, wherein said carrying means in said punch carrier comprise vertical bores.

11. A punch assembly according to claim 6, wherein lubricating passages are provided between each of the moving parts of the punch assembly.

12. A punch assembly according to claim 6, wherein said punch carrier means is biased into clamped engagement with said striker means to cause said punch carrier means to move vertically with said striker means, however permitting rotational movement of said punch carrier means relative to said striker means.

13. A punch assembly according to claim 6, wherein said punch carrier means is coupled to said stripper guide means by a radially projecting pin carried by one of said punch carrier means and said stripper guide means received in a vertical slot in the other of said carrier means and guide means.

14. A retaining means for stripper buttons in a punch press punch assembly comprising:

a stripper guide means for receiving a plurality of stripper buttons at one end of said guide means;

a retaining ring means surrounding said one end of said guide means and having spaced retaining flanges for alternatively overlying a portion of said stripper buttons or being spaced between said stripper buttons depending on the angular relationship of said retaining means and said guide means; and detent means engageable between said stripper guide means and said retaining ring to hold said retaining ring in a selected angular position relative to said guide means.

15. A retaining means according to claim 14, wherein said stripper guide means includes a plurality of undercut slots for receiving said buttons, said slots being open toward a periphery of said stripper guide means surrounded by said ring means.

16. A retaining means according to claim 14, wherein said spaced retaining flanges on said retaining ring means include undercut portions to receive a portion of said buttons.

17. A retaining means according to claim 14, wherein said detent means comprise a projection carried by one of said stripper guide means and said ring being biased into engagement with a selected one of a plurality of spaced recesses in the other of said guide means and ring.

18. A die retaining means for use in a punch press, comprising:

a die carrier mounted for rotation in said punch press;

a plurality of individual die buttons carried on said die carrier; said die buttons having openings therethrough corresponding to punch shapes carried by said punch press;

a plurality of keys held on said die carrier for selected engagement with said die buttons; certain of said die buttons which have said openings that are non-circular, also having key slots engageable with said keys to hold said die buttons in selected orientations; said keys being reversible between engaging and non-engaging positions; and retaining means for holding said buttons in said die carrier.

19. A die retaining means according to claim 18, wherein said keys have a rectangular shape and are secured by means of a threaded fastener extending through said key at a location spaced from a center of the key, such that, as measured from said fastening location, said keys have a long end and a short end.

20. A die retaining means according to claim 18, wherein said retaining means comprise horizontally oriented set screws.

21. A punch press according to claim 1, wherein said punch carrier means underlies said striker means and is rotatable relative to said striker means, said punch carrier means having means therein for carrying a plurality of separate punches, said stripper guide means underlying said punch carrier means and being vertically movable relative to said punch carrier means, said punch carrier means being coupled to move vertically with said striker means and being coupled to rotate about a vertical axis with said stripper guide means.

22. A punch press according to claim 1 including a retaining means for stripper buttons comprising:

said stripper guide means receiving a plurality of stripper buttons at one end of said guide means;

a retaining means surrounding one of said guide means and having spaced retaining flanges for alternatively overlying a portion of said stripper buttons or being spaced between said stripper buttons depending on the angular relationship of said retaining means and said guide means; and detent means engageable between said stripper guide means and said retaining ring to hold said retaining ring in a selected angular position relative to said guide means.

23. A punch press according to claim 1 including a die retaining means comprising:

a die carrier mounted for rotation in said punch press;

a plurality of individual die buttons carried on said die carrier; said die buttons having openings therethrough corresponding to punch shapes carried by said punch press;

a plurality of keys held on said die carrier for selected engagement with said die buttons;

certain of said die buttons which have said openings that are non-circular, also having key slots engageable with said keys to hold said die buttons in selected orientation;

said keys being reversible between engaging and non-engaging position; and retaining means for holding said buttons in said die carrier.

24. A punch press according to claim 1, wherein said punch carrier means underlies said striker means and is rotatable relative to said striker means, said punch carrier means having means therein for carrying a plurality of separate punches, said stripper guide means underlying said punch carrier means and being vertically movable relative to said punch carrier means, said punch carrier means being coupled to move vertically with said striker means and being coupled to rotate about a vertical axis with said stripper guide means, including a retaining means for stripper buttons comprising:

said stripper guide means receiving a plurality of stripper buttons at one end of said guide means;

a retaining means surrounding one of said guide means and having spaced retaining flanges for alternatively overlying a portion of said stripper buttons or being spaced between said stripper buttons depending on the angular relationship of said retaining means and said guide means; and detent means engageable between said stripper guide means and said retaining ring to hold said retaining ring in a selected angular position relative to said guide means;

and further including a die retaining means comprising:

a die carrier mounted for rotation in said punch press;

a plurality of individual die buttons carried on said die carrier;

said die buttons having openings therethrough corresponding to punch shapes carried by said punch press;

a plurality of keys held on said die carrier for selected engagement with said die buttons;

certain of said die buttons which have said openings that are non-circular, also having key slots engageable with said keys to hold said die buttons in selected orientation;

said keys being reversible between engaging and non-engaging position; and retaining means for holding said buttons in said die carrier.

* * * * *